US005934959A

United States Patent [19]

Inman, Sr. et al.

[11] Patent Number: 5,934,959

[45] Date of Patent: Aug. 10, 1999

[54] MARINE MUFFLER

[75] Inventors: Frederick R. Inman, Sr.; Frederick R. Inman, Jr., both of Glendora, Calif.

[73] Assignee: Inman Marine Corporation, San Dimas, Calif.

[21] Appl. No.: 08/967,678

[22] Filed: Nov. 10, 1997

[51] Int. Cl.[6] ..... B63H 21/32

[52] U.S. Cl. ..... 440/89; 181/256

[58] Field of Search ..... 181/256; 440/89

[56] References Cited

U.S. PATENT DOCUMENTS

| | | | |
|---|---|---|---|
| 3,296,997 | 1/1967 | Hoiby et al. . | |
| 3,710,891 | 1/1973 | Flugger | 181/256 |
| 3,987,868 | 10/1976 | Betts | 181/57 |
| 4,000,786 | 1/1977 | Ford | 181/52 |
| 4,019,456 | 4/1977 | Harbert | 115/73 |
| 4,263,982 | 4/1981 | Feuling | 181/256 |
| 4,416,350 | 11/1983 | Hayashi | 181/272 |
| 4,734,071 | 3/1988 | Zemlicka et al. | 440/89 |
| 4,787,869 | 11/1988 | Shiozawa | 440/89 |
| 4,890,691 | 1/1990 | Ching-ho | 181/264 |
| 5,078,631 | 1/1992 | Harbert | 440/89 |
| 5,183,976 | 2/1993 | Plemons, Jr. | 181/264 |
| 5,196,655 | 3/1993 | Woods | 181/235 |
| 5,253,603 | 10/1993 | Mascolo | 114/20.1 |
| 5,536,189 | 7/1996 | Mineo | 440/89 |
| 5,554,058 | 9/1996 | LeQuire | 440/89 |
| 5,556,314 | 9/1996 | Fukuda et al. | 440/89 |
| 5,588,888 | 12/1996 | Magharious | 440/89 |
| 5,591,058 | 1/1997 | Schriever et al. | 440/89 |

*Primary Examiner*—Stephen Avila
*Attorney, Agent, or Firm*—Christie, Parker & Hale, LLP

[57] ABSTRACT

A muffler comprises a housing having an exhaust inlet and an exhaust outlet. A first exhaust chamber is disposed concentrically within the housing and is connected with the exhaust inlet. The first exhaust chamber includes a plurality of openings through a first exhaust chamber wall for distributing exhaust gas radially outwardly therethrough. A second exhaust chamber is disposed concentrically around the first exhaust chamber and receives exhaust gas passed to it from the first exhaust chamber. The second exhaust chamber is defined along an outside diameter by a second exhaust chamber wall that comprises a plurality of openings therethrough for passing exhaust gas radially outwardly therefrom. The second exhaust chamber is in communication with the muffler outlet. A third exhaust chamber that is disposed concentrically around the second exhaust chamber for receiving exhaust gas from the second exhaust chamber. The third exhaust chamber is defined along an outside diameter by the muffler housing. A sound attenuating medium is disposed within the third exhaust chamber. The muffler includes means for preventing air and water from entering the muffler outlet.

29 Claims, 2 Drawing Sheets

MARINE MUFFLER

FIELD OF THE INVENTION

This invention relates to mufflers used to reduce the sound level of engine exhaust and, more particularly, relates to a marine muffler construction that is designed to reduce the sound level of an engine exhaust without increasing resistance to air flow through the muffler when compared to a conventional muffler.

BACKGROUND OF THE INVENTION

Mufflers used for silencing the exhaust from internal combustion engines in marine applications are known in the art and typically comprise a housing into which the exhaust gasses from the engine and sea water are routed. The muffler is typically connected to the transom of the watercraft or boat and the muffler outlet is routed above the water surface to avoid back pressure. The muffler housing has an internal construction designed to facilitate the passage of the exhaust gas therethrough while also deadening the sound waves of the exhaust gas to reduce the sound of the exhaust gas exiting the muffler outlet.

Conventional mufflers are designed to reduce the sound of the exhaust gas passing therethrough by either absorbing a portion of the sound waves, or by destructing the sound waves by reflection or expansion. Mufflers that are designed to attenuate the exhaust sound typically comprise a packing formed of an absorptive material or the like through which the exhaust gas is routed. Mufflers that are designed to destruct the sound waves by reflection or expansion typically comprise an arrangement of interconnected expansion chambers or a series of baffles position within the path of the exhaust gas. In either case, the use of such techniques whether effective or not adversely impacts the performance of the engine by increasing the air flow resistance or backpressure through the muffler. Routing the exhaust gas through the tortious path of chambers and/or baffles, or through an absorptive packing, increases the resistance of gas flow through the muffler, thereby restricting the free flow of exhaust gas from the engine and ultimately decreasing engine horsepower and performance.

It is, therefore, desired that a muffler be constructed that is capable of reducing the sound level of exhaust gas passing therethrough without increasing airflow resistance through the muffler, when compared with conventional mufflers. It is also desired that the muffler be constructed in a manner, and from a suitable material, to enable its use with internal combustion engines in a marine environment, e.g., with inboard-powered boats and watercraft, and the like.

SUMMARY OF THE INVENTION

A muffler, constructed according to principles of this invention, for silencing the exhaust noise from an internal combustion engine comprises a muffler housing having an exhaust inlet at one end and an exhaust outlet at an opposite end. A first exhaust chamber is disposed concentrically within the housing and is in communication with the exhaust inlet. The first exhaust chamber includes a plurality of openings through a first exhaust chamber wall for distributing exhaust gas radially outwardly therethrough. A second exhaust chamber is disposed concentrically around the first exhaust chamber and receives exhaust gas passed to it from the first exhaust chamber. The second exhaust chamber is defined along an outside diameter by a second exhaust chamber wall that comprises a plurality of openings therethrough for passing exhaust gas radially outwardly therefrom. The second exhaust chamber is in communication with the muffler outlet.

The muffler includes a third exhaust chamber that is disposed concentrically around the second exhaust chamber for receiving exhaust gas from the second exhaust chamber. The third exhaust chamber is defined along an outside diameter by the muffler housing and includes a sound attenuating medium disposed therein. The muffler includes means for preventing air and water from entering the muffler outlet at low or no exhaust flow conditions.

Exhaust gas entering the muffler inlet is passed into the first exhaust chamber, where it is distributed uniformly radially outwardly into the second exhaust chamber, where the exhaust gas velocity is reduced. Exhaust gas is passed radially outwardly from the second exhaust chamber into the third exhaust chamber, where the gas is passed through the sound attenuating medium. Exhaust gas exiting the second and third exhaust chambers is routed past the means for preventing and exits the muffler exhaust outlet.

Mufflers of this invention reduce the sound level of an engine exhaust in the range of from 20 to 30 decibels without increasing airflow resistance through the muffler, when compared to conventional muffler designs.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION

A muffler constructed according to principles of this invention comprises a concentric arrangement of first, second and third exhaust chambers that are designed to reduce the sound level of exhaust gas existing the muffler without increasing airflow resistance-through the muffler, when compared to a conventional muffler.

Figure 1:
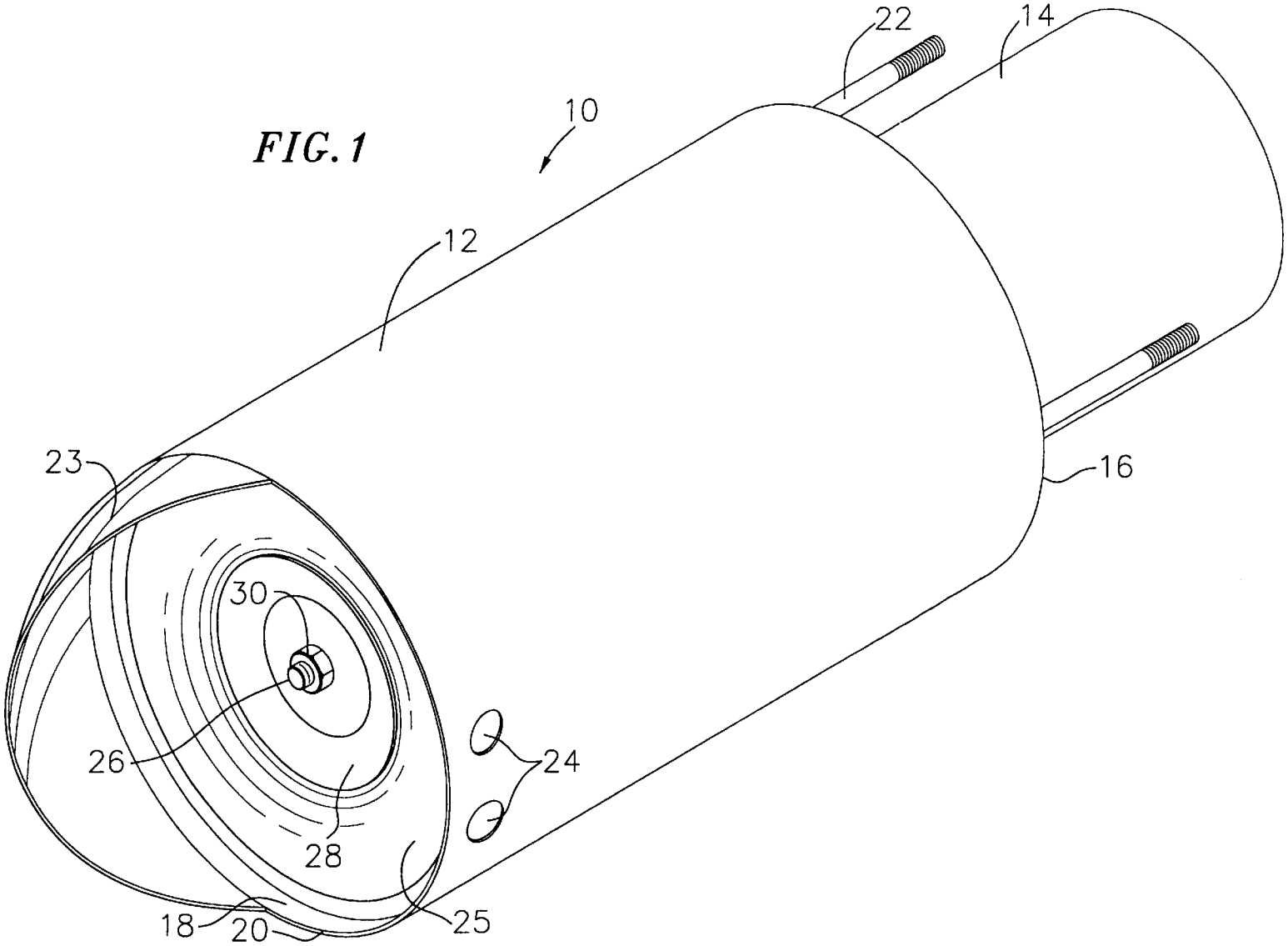
FIG. 1 is a perspective view of a muffler constructed according to principles of this invention.

Referring to FIG. 1, an example muffler 10 of this invention comprises a housing 12 that is generally cylindrical in shape, having an exhaust inlet pipe 14 extending axially away from a first muffler housing end 16, and an exhaust outlet 18 at an opposite muffler second end 20. The muffler housing 12 is adapted to be connected with a transom (not shown) of a watercraft so that the exhaust inlet pipe 14 extends through a portion of the transom and is connected to an exhaust header pipe (not shown) that is used to route exhaust gas from the engine to the transom. The muffler housing 12 comprises means for mounting the muffler to the transom in the form of studs 22 that extend axially outwardly away from the first end 16. Alternatively, it is to be understood that conventional attachment means other than studs can be used.

It is to be understood that the length and diameter of the muffler housing 12 will vary depending on the size of the particular application. For an example application, the muffler housing 12 has a length of approximately 25 centimeters as measured from the first to second end, and has an outside diameter of approximately 15 centimeters. The exhaust inlet pipe 14, for such example application, has an outside diameter of approximately 10 centimeters, and has a length of approximately 12 centimeters. The muffler housing 12 is preferably formed from a corrosion resistant metal or metal alloy. In an example embodiment, the muffler housing 12 and exhaust inlet pipe 14 are each formed from 300 series stainless steel.

The muffler second end 20 includes a turndown lid 23 that is positioned at the top of the muffler housing, that extends a distance axially away from the second end, and that is directed downwardly towards a bottom of the muffler housing. The turndown lid 23 is an optional feature that is used to direct exhaust gas exiting from the muffler outlet away from adjacent structural portions of the watercraft, e.g., swim platform and the like. Functioning in such manner, the turndown lid 23 can prevent the unwanted buildup of carbon on such adjacent watercraft structural portion. The turndown lid 23 is formed from the same materials noted above that can be used to form the muffler housing. The muffler housing 12 also includes water exit ports 24 extending through a housing wall and positioned at a bottom end of the muffler second end 18 to facilitate the outward flow of water from the muffler housing 12.

A flapper valve 25 is positioned at the exhaust outlet 18 and extends diametrically thereacross to act as a one-way check valve to prevent the back flow of air or water into the muffler at low or no exhaust flow conditions. The flapper valve 25 is attached to the muffler by suitable attachment means. In the example embodiment, the flapper valve is secured to the muffler by the treaded arrangement of a stud 26, extending from the muffler and through a center of the flapper valve, a backing plate 28 disposed over a frontside surface of the flapper valve, and a nut 30 threaded onto the stud 26 securing the flapper valve snugly between the muffler and the backing plate 28.

The flapper valve 25 is formed from a sheet of resilient material that is capable of both being fixedly mounted to the muffler the center of the sheet, and being movable along its edge portion to permit the escape of exhaust gas between it and an adjacent wall of the muffler. A key design feature of this invention is the construction of the flapper valve that permits the one-way flow of exhaust from the muffler outlet, and seals against the muffler around a 360 degree area. The use of such 360 degree seal across the exhaust passage allows the flapper valve to both provide an improved seal against the muffler, to thereby provide enhanced protection against air or water back flow into the muffler, and to provide a less restrictive flow path for exhaust gases leaving the muffler, thereby reducing airflow resistance or back pressure through the muffler. Suitable materials for forming the flapper valve include elastomeric materials, fiber-reinforced elastomeric materials and the like. A preferred material used for forming the flapper valve is silicone rubber.

Figure 2:
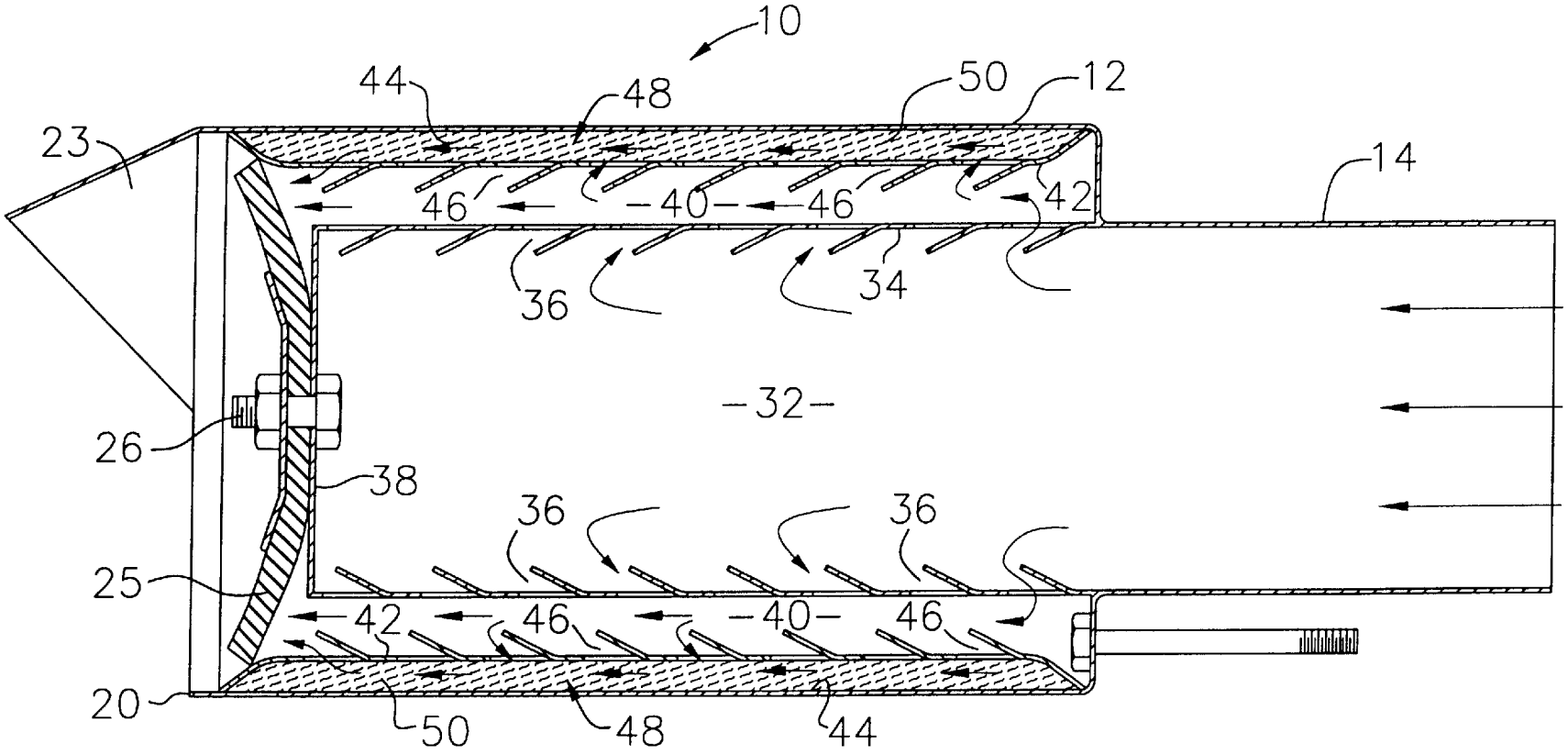
FIG. 2 is a cross-section side view of a muffler constructed according to principles of this invention.

Referring to FIG. 2, The muffler housing 12 comprises a first exhaust chamber 32 that is disposed concentrically therein. The first chamber 32 extends axially within the chamber a distance from the exhaust inlet pipe 14 and has a cylindrical shape. The first chamber 32 includes a wall portion 34 that is perforated, comprising a plurality of openings 36 extending therethrough. In an example embodiment, the openings 36 are in the form of louvered openings that are directed radially inwardly into the first chamber. In such example embodiment the louvered openings are arranged so that each opening is directed axially away from the exhaust inlet pipe 14. It was discovered that orienting the louvered openings in this manner, rather that orienting them toward the exhaust inlet pipe to catch the exhaust gas as it enters the first exhaust chamber, takes advantage of aerodynamic low pressure that is created at a backside of the louvers to suck the exhaust gases through the openings, thereby reducing airflow resistance as the exhaust gas passes through the first exhaust chamber.

The first chamber wall portion 34 is preferably formed from a corrosion-resistant material metal or metal alloy, such as that desired above for use in forming the muffler housing. In a preferred embodiment, the first chamber wall portion 34 is formed from 300 series stainless steel, and the louvers 36 are formed by first cutting slits through the wall and then punching the cut portions inwardly.

The first exhaust chamber 32 includes a closed end 38, opposite from the exhaust inlet pipe 14 that defines its length. The closed end 38 is positioned within the housing 12 a distance axially inwardly from the housing second end 20. The closed end 38 includes the stud 26 described above for securing the flapper valve 25 to an opposite closed end surface.

Configured in this manner, the first exhaust chamber 32 functions to route exhaust gas entering therein via the exhaust inlet pipe 14 radially outwardly through the plurality of louvers 36 in the wall portion 34. As the exhaust gas passes through the first exhaust chamber 32, the plurality of louvered openings 36 act to condition the exhaust gas passed therethrough by evenly distributing the exhaust gas flow throughout a 360 degree surface area leaving the first exhaust chamber. Water entering the muffler is also allowed to pass through the plurality louvers 36 for subsequent removal from the muffler via the water exit ports 24. In an example embodiment, constructed for use with a particular application, the first exhaust chamber 32 has an outside diameter of approximately 10 centimeters, and has an axial length of approximately 20 centimeters.

An annular second exhaust chamber 40 is disposed concentrically outside of the first exhaust chamber wall portion 34, is defined along an inside diameter by an outside surface of the first exhaust chamber wall portion 34, and along an outside diameter by a cylindrical second exhaust chamber wall 42. The second exhaust chamber wall 42 is disposed concentrically within an inside wall surface 44 of the muffler housing 12, extends axially along the length of the muffler housing, and is attached and sealed at its opposite axial ends to the muffler housing inside wall surface 44.

The second exhaust chamber wall 42 is formed from the same corrosion-resistant materials described above for the muffler housing, and is perforated with a plurality of openings 46 in the form of louvered openings extending therethrough. It is desired that the plurality of louvered openings 46 be configured directing radially inwardly towards the first exhaust chamber wall portion 34. It is also desired that the opening of each louver be directed towards the muffler housing outlet 20, to take advantage of aerodynamic low pressure effects that reduce air flow restriction through the muffler as discussed above for the first exhaust chamber. In an example embodiment, designed for the same application as that described above, the second exhaust chamber 40 has an inside diameter of approximately 13 centimeters (as measured across the second exhaust chamber wall 42), and has an axial length of approximately 24 centimeters.

An annular third exhaust chamber 48 is interposed between the second exhaust chamber wall 48 and the muffler housing inside wall surface 44. The third exhaust chamber 48 comprises sound attenuating material 50 disposed therein to deaden the sound level of exhaust gas passing to it from the first and second exhaust chambers. Suitable sound attenuating materials include those formed from steel, fiber, fabric or other such materials conventionally used for sound deadening. In a preferred embodiment, the sound attenuating material is in the form of stainless steel wool packing.

Together, the second and third exhaust chambers 40 and 48 are sized having a greater volumetric area than the first exhaust chamber 32, thereby causing the flow velocity of the exhaust gas to be reduced as it passes from the first exhaust chamber to the second and third exhaust chambers without creating additional back pressure. The exhaust gas exiting the first exhaust chamber enters the second exhaust chamber 40 and contacts the second exhaust chamber wall 42, where a portion of the exhaust gas is direct radially outwardly into the third exhaust chamber 48. As such portion of exhaust gas is routed through the third exhaust chamber 48 towards the muffler housing second end 20, the sound level of the gas is reduced by the sound attenuating material. A remaining portion of the exhaust gas is routed axially along the second exhaust chamber 40 towards the muffler housing second end 20. As the flow of the exhaust gas within the third exhaust chamber approaches the muffler housing second end 20, it is directed radially inwardly back into the second exhaust chamber 40 where it is joined with the remaining exhaust gas flow. Water exiting the first exhaust chamber passes through the openings 46 in the second exhaust chamber 40 and is allowed to collect along a bottom portion of the third exhaust chamber 48, where it is routed from the muffler housing via the water exit ports 24 (shown in FIG. 1).

The flapper valve 25 is disposed within the muffler housing having its non-fixed or movable edge portion positioned diametrically across an exhaust gas outlet path from the second exhaust chamber 40. The flapper valve 25 is constructed so that the pressure of exhaust gas within the second exhaust chamber is sufficient to break the 360 degree seal between the flapper valve edge and the muffler housing inside wall surface or the second exhaust chamber wall 42, to facilitate the one-way checked passage of exhaust gas therefrom, and is designed to prevent water and air from entering the muffler at low or no exhaust pressure condition.

It has been discovered that when operating to reduce the sound level of an engine exhaust, when the engine is operating at or near idle, an amount of air will enter a conventional muffler via the muffler outlet. The extra amount of air that enters the muffler is known to further increase the sound level of the exhaust exiting the muffler, since the volumetric flow of the exhaust gas through the muffler is being increased. A key feature of this invention is the use of the flapper valve 25 that prevents air from entering the muffler outlet at low or no exhaust pressure conditions, thereby controlling the volumetric flow of exhaust through the muffler to that only being produced by the engine, and thereby reducing the exhaust sound level. Use of the flapper valve with the muffler of this invention is known to reduce engine exhaust noise from the muffler at idle conditions by at least five decibels.

Mufflers, constructed according to principles of this invention, employ four different methods to reduce the sound level of engine exhaust noise passing therethrough. A first method involves conditioning exhaust gas entering the first exhaust chamber 32 by passing it radially outward through the louvered openings 36 around a 360 degree area, thereby distributing the exhaust gas uniformly within the muffler. A second method is by reducing the velocity of the exhaust gas passing from the first exhaust chamber 32 by routing it to second and third exhausts chambers 40 and 48, having a greater volumetric area than that of the first exhaust chamber. A third method is by routing the reduced velocity exhaust gas through a sound attenuating medium 50 within the third exhaust chamber 48. A fourth method is by controlling the amount of air flow through the muffler by preventing air from entering the muffler outlet via the flapper valve 25.

A key feature of this muffler, constructed to allowing the operation of such methods, is that it significantly reduces the sound level of exhaust gas exiting the muffler, and does so without increasing air flow resistance or back pressure through the muffler, when compared with conventional muffler designs. For example, depending on the particular application, mufflers of this invention can reduce the sound level of engine exhaust in the range of from 20 to 30 decibels, when compared to conventional mufflers, and do so without increasing air flow resistance through the muffler.

Although limited embodiments of marine mufflers of this invention have been described and illustrated herein, many modifications and variations will be apparent to those skilled in the art. Accordingly, it is to be understood that within the scope of the appended claims, seal systems of this invention may be embodied other than as specifically described herein.

What is claimed is:

1. A muffler for an internal combustion engine comprising:

a housing having an exhaust inlet at one end and an exhaust outlet at an opposite end;

a first exhaust chamber disposed within the muffler housing having:

a first end in gas-flow communication with the exhaust inlet;

a closed end opposite the first end; and a wall extending between the first and second end having a plurality of openings therethrough;

an second exhaust chamber disposed concentrically around an outside of the first exhaust chamber, the second exhaust chamber being defined radially along an inside diameter by first exhaust chamber wall and along an outside diameter by a second exhaust chamber wall, wherein the second exhaust chamber wall comprises a plurality of openings therethrough, and wherein the second exhaust chamber extends axially from a closed end adjacent the first exhaust chamber first end to an open end forming the muffler housing outlet;

a third exhaust chamber disposed concentrically around an outside of the second exhaust chamber, the third exhaust chamber being defined along an inside diameter by second exhaust chamber wall and along an outside diameter by wall surface of the muffler housing, wherein the third exhaust chamber comprises a sound attenuating medium disposed therein, and wherein the third exhaust chamber extends axially from the second exhaust chamber closed end to the muffler housing outlet; and means disposed at the muffler housing exhaust outlet to prevent water and air from entering the muffler exhaust outlet;

wherein exhaust gas exits the muffler from open end of the second exhaust gas chamber.

2. The muffler as recited in claim 1 wherein the plurality of openings through the first exhaust chamber wall is in the form of louvers that are directed radially inwardly into first exhaust chamber.

3. The muffler as recited in claim 2 wherein the plurality of openings through the first exhaust chamber wall are directed toward the closed end of the first exhaust chamber.

4. The muffler as recited in claim 1 wherein the plurality of openings through the second exhaust chamber wall is in the form of louvers that are directed radially inwardly into the second exhaust chamber.

5. The muffler as recited in claim 4 wherein the plurality of openings through the second exhaust chamber wall are directed toward the muffler exhaust outlet.

6. The muffler as recited in claim 1 wherein the means for preventing water and air from entering the muffler outlet is in the form of a sheet of resilient material disposed diametrically across the muffler exhaust outlet.

7. A muffler comprising:

a housing having an exhaust inlet at one end and an exhaust outlet at an opposite end;

a first exhaust chamber disposed concentrically within the housing and connected to the exhaust inlet, wherein the first exhaust chamber includes a plurality of openings through a first exhaust chamber wall for passing exhaust gas therethrough;

a second exhaust chamber disposed concentrically around an outside of the first exhaust chamber for receiving exhaust gas passed from the first exhaust chamber, wherein the second exhaust chamber is defined along an outside diameter by a second exhaust chamber wall comprising a plurality of openings therethrough, and wherein the second exhaust chamber includes an open axial end that forms the muffler outlet;

a third exhaust chamber disposed concentrically around the second exhaust chamber for receiving exhaust gas from the second exhaust chamber, the third exhaust chamber being defined along an outside diameter by the muffler housing; and means for preventing air and water from entering the muffler outlets;

wherein exhaust gas exits the muffler from the open end of the second exhaust chamber.

8. The muffler as recited in claim 7 wherein the first exhaust chamber wall is in the form of a cylinder and the plurality of openings therethrough are in the form of louvers.

9. The muffler as recited in claim 8 wherein the louvers are directed radially inwardly into the first exhaust chamber.

10. The muffler as recited in claim 9 wherein the openings through the first exhaust chamber wall are directed away from the exhaust inlet.

11. The muffler as recited in claim 7 wherein the second exhaust chamber wall is in the form of a cylinder and the plurality of openings therethrough are in the form of louvers.

12. The muffler as recited in claim 11 wherein the louvers through the second exhaust chamber wall are directed radially inwardly into the second exhaust chamber.

13. The muffler as recited in claim 12 wherein the openings through the second exhaust chamber wall are directed towards the exhaust outlet.

14. The muffler as recited in claim 7 wherein the means for preventing air and water from entering the muffler outlet is in the form of a barrier disposed across the exhaust outlet that is formed from a resilient material that forms releasible seal against the exhaust outlet to permit the escape of exhaust gas thereby.

15. The muffler as recited in claim 14 wherein the barrier is a sheet of resilient material that is attached to the muffler at a central portion and forms a seal against the exhaust outlet along a peripheral edge of the sheet.

16. A muffler for reducing the noise level of an engine exhaust comprising:

a muffler housing having a hollow cavity extending axially therethrough from an exhaust inlet at one housing end to an exhaust outlet at an opposite housing end;

a first cylindrical duct disposed concentrically within the housing cavity, the first cylindrical duct having a first end in communication with the exhaust inlet, a closed second end, and a cylindrical wall extending axially therebetween comprising a plurality of openings therethrough for distributing exhaust gas radially outwardly therefrom, wherein the plurality of openings are in the form of louvers that project radially inwardly into the first cylindrical duct;

a second cylindrical duct disposed concentrically within the housing cavity around the first cylindrical duct, the second cylindrical duct having a closed first end, a second open end that forms the muffler exhaust outlet, and a cylindrical wall extending axially therebetween comprising a plurality of openings therethrough for distributing exhaust gas radially outwardly therefrom, wherein the plurality of openings through the second cylindrical duct are in the form of louvers that project radially inwardly into the second cylindrical duct;

a sound attenuating chamber defined along an inside diameter by the second cylindrical duct, and defined along an outside diameter by the muffler housing, wherein the sound attenuating chamber extends axially between the second cylindrical duct first and second ends; and a sound attenuating material disposed within the sound attenuating chamber;

wherein exhaust gas exits the muffler from the open end of the second cylindrical duct.

17. The muffler as recited in claim 16 further comprising means for preventing air and water from entering the exhaust outlet.

18. The muffler as recited in claim 16 wherein the openings in the first and second cylindrical ducts are oriented towards the direction of exhaust gas flow through respective first and second cylindrical ducts.

19. A method for reducing exhaust noise from an engine comprising the steps of:

passing exhaust gas from the engine into a first exhaust chamber disposed within a muffler;

distributing the exhaust gas through a plurality of openings through a wall of the first exhaust chamber to a second exhaust chamber;

routing exhaust gas from the second exhaust chamber through a plurality of openings through a wall of the second exhaust chamber to a third exhaust chamber;

passing the exhaust gas in the third exhaust chamber through a sound attenuating medium; and passing the exhaust gas back into the second exhaust chamber at out of the muffler through an open end of the second exhaust chamber.

20. The method as recited in claim 19 wherein during the step of distributing, the exhaust gas is distributed radially outwardly 360 degrees within the muffler into the second exhaust chamber.

21. The method as recited in claim 19 wherein during the step of routing, a portion of the exhaust gas is directed axially through the second exhaust chamber, and a portion of the exhaust gas is directed radially outwardly into the third exhaust chamber.

22. The method as recited in claim 19 wherein during the step of passing the exhaust gas through a sound attenuating medium, the gas is passed axially therethrough.

23. The method as recited in claim 19 further comprising the step of passing the exhaust gas exiting the second and third exhaust chamber by a means for preventing air and water flow into the exhaust outlet.

24. A method for reducing the sound level of engine exhaust exiting a muffler comprising the steps of:

passing engine exhaust gas into a first exhaust chamber connected to a muffler exhaust inlet;

distributing exhaust gas entering the first exhaust chamber radially outwardly from a plurality of openings therethrough into a concentrically positioned second exhaust chamber;

routing the exhaust gas entering the second exhaust chamber radially outwardly from a plurality of openings therethrough into a concentrically positioned third exhaust chamber;

passing the exhaust gas entering the third exhaust chamber through a sound attenuating material disposed therein; and permitting exhaust gas in the second and third exhaust chambers to exit the muffler through an exhaust outlet formed by an open end of the second exhaust chamber; and preventing air and water from entering the exhaust outlet.

25. The method as recited in claim 24 wherein during the step of distributing, the exhaust gas is passed through openings in the first exhaust chamber that are in the form of louvers extending radially inwardly into the first exhaust chamber.

26. The method as recited in claim 25 wherein the exhaust gas is passed through openings in the first exhaust chamber that are directed away from the muffler exhaust inlet.

27. The method as recited in claim 24 wherein during the step of routing, the exhaust gas is passed through openings in the second exhaust chamber that are in the form of louvers extending radially inwardly into the second exhaust chamber.

28. The method as recited in claim 27 wherein the exhaust gas is passed through openings in the second exhaust chamber that are directed towards the muffler exhaust outlet.

29. The method as recited in claim 24 wherein during the step of preventing, the exhaust gas exiting the muffler is passed by a barrier disposed across the muffler exhaust outlet that is attached to the muffler at a center portion, and that forms a one-way air and liquid seal with the muffler exhaust outlet.

* * * * *